US010020623B1

(12) United States Patent
Meehan

(10) Patent No.: US 10,020,623 B1
(45) Date of Patent: Jul. 10, 2018

(54) ELECTRICAL CIRCUIT JUMPER CABLE ASSEMBLY FOR TESTING

(71) Applicant: Hughie Meehan, Landenberg, PA (US)

(72) Inventor: Hughie Meehan, Landenberg, PA (US)

( * ) Notice: Subject to any disclaimer, the term of this patent is extended or adjusted under 35 U.S.C. 154(b) by 0 days.

(21) Appl. No.: 15/459,912

(22) Filed: Mar. 15, 2017

(51) Int. Cl.

| | |
|---|---|
| ***H01R 4/24*** | (2018.01) |
| ***H01R 25/16*** | (2006.01) |
| ***H01R 4/26*** | (2006.01) |
| ***H01R 4/70*** | (2006.01) |

(52) U.S. Cl.
CPC ..... *H01R 25/162* (2013.01); *H01R 4/26* (2013.01); *H01R 4/70* (2013.01)

(58) Field of Classification Search
CPC ..... H01R 11/18; H01R 13/2428
USPC ..... 439/482, 912, 521, 892; 174/138 F
See application file for complete search history.

(56) References Cited

U.S. PATENT DOCUMENTS

| | | | | |
|---|---|---|---|---|
| 3,851,149 | A | 11/1974 | Daley | |
| 4,211,456 | A | 7/1980 | Sears | |
| 5,816,059 | A | 10/1998 | Ficchi, Jr. et al. | |
| 7,104,815 | B2 * | 9/2006 | Ng | H01R 11/24 439/135 |
| 7,867,021 | B1 * | 1/2011 | Brant | H01R 4/40 439/504 |
| 8,016,599 | B1 | 9/2011 | Melby et al. | |
| 2015/0079811 | A1 | 3/2015 | Yi | |

FOREIGN PATENT DOCUMENTS

| | | |
|---|---|---|
| CN | 201450133 U | 5/2010 |
| CN | 104241887 A | 6/2013 |
| FR | 2490415 A1 | 3/1982 |

OTHER PUBLICATIONS

Abstract of FR2490415, dated Mar. 19, 1982, 2 pages.
Abstract of CN201450133, dated May 5, 2010, 1 page.
Abstract of CN104241887, dated Dec. 24, 2014, 1 page.
English machine translation of FR2490415, dated Mar. 19, 1982, 4 pages.

* cited by examiner

*Primary Examiner* — Phuong Dinh
(74) *Attorney, Agent, or Firm* — Barley Snyder

(57) ABSTRACT

An electric circuit jumper cable assembly having a plurality of leads electrically connected serially at first ends of the leads to form an electrical junction within a bus within a housing; a plurality of terminals individually connected at second ends of the leads, each terminal having: a base, an electrically conductive tip in the base electrically connected to one of the leads; and a cover element relative to the base that selectively shields at least a portion of the electrically conductive tip. The electric circuit jumper cable assembly is useful for convenient testing of electrical circuits.

15 Claims, 16 Drawing Sheets

ELECTRICAL CIRCUIT JUMPER CABLE ASSEMBLY FOR TESTING

FIELD OF THE INVENTION

This present invention relates to an electric circuit jumper cable and, more particularly, to an electrical jumper cable for use in electrical equipment maintenance and service for use in testing and troubleshooting electric circuits in heating, ventilation, and air conditioning (HVAC) systems.

BACKGROUND

Increasingly complicated HVAC products involve multiple systems controlling heating, air conditioning, lighting, and fans. Installation, operation, and maintenance of these systems requires that installers, operators, and service people have access to testing equipment that is convenient to use, easily portable, and compact.

Previously, operators and technicians would test the circuits of an HVAC system with a single lead, requiring repeated manipulations of the testing equipment to survey the multiple functions.

SUMMARY

This claimed invention addresses the deficiencies and shortcomings of known devices.

An electrical jumper cable assembly is provided and includes multiple output ends having terminals allowing for convenient use in servicing and/or troubleshooting HVAC control circuits and similar electrical-mechanical equipment and systems with multiple-functions.

The electrical jumper cable assembly in accordance with the present invention includes a plurality of leads electrically connected serially at first ends of the leads forming an electrical junction within a bus and a plurality of terminals individually connected to the leads at second ends of the leads. Each terminal has a base, an electrically conductive tip in the base electrically connected to one of the leads, and a cover element relative to the base that selectively shields at least a portion of the electrically conductive tip. An electric circuit jumper cable, constructed in accordance with the present invention, also includes a fastener at the electrical junction of the conductors adapted to hang the electric circuit jumper cable on a unit with which the electric circuit jumper cable is being used. An electrical jumper cable also includes various embodiments of cover elements that are moveable relative to the electrically conductive tip or various embodiments of find cross an electrically conductive tip moveable relative to the cover element. The electric circuit jumper cable assembly is useful for convenient testing of conductivity of electrical circuits.

BRIEF DESCRIPTION OF THE DRAWINGS

The present invention will be explained in greater detail with reference to embodiments and referring to the appended drawings, in which.

DETAILED DESCRIPTION OF THE EMBODIMENT(S)

Now with reference to FIGS. 1-31, an electric circuit jumper cable assembly 1 according to the invention will be described.

Figure 1:
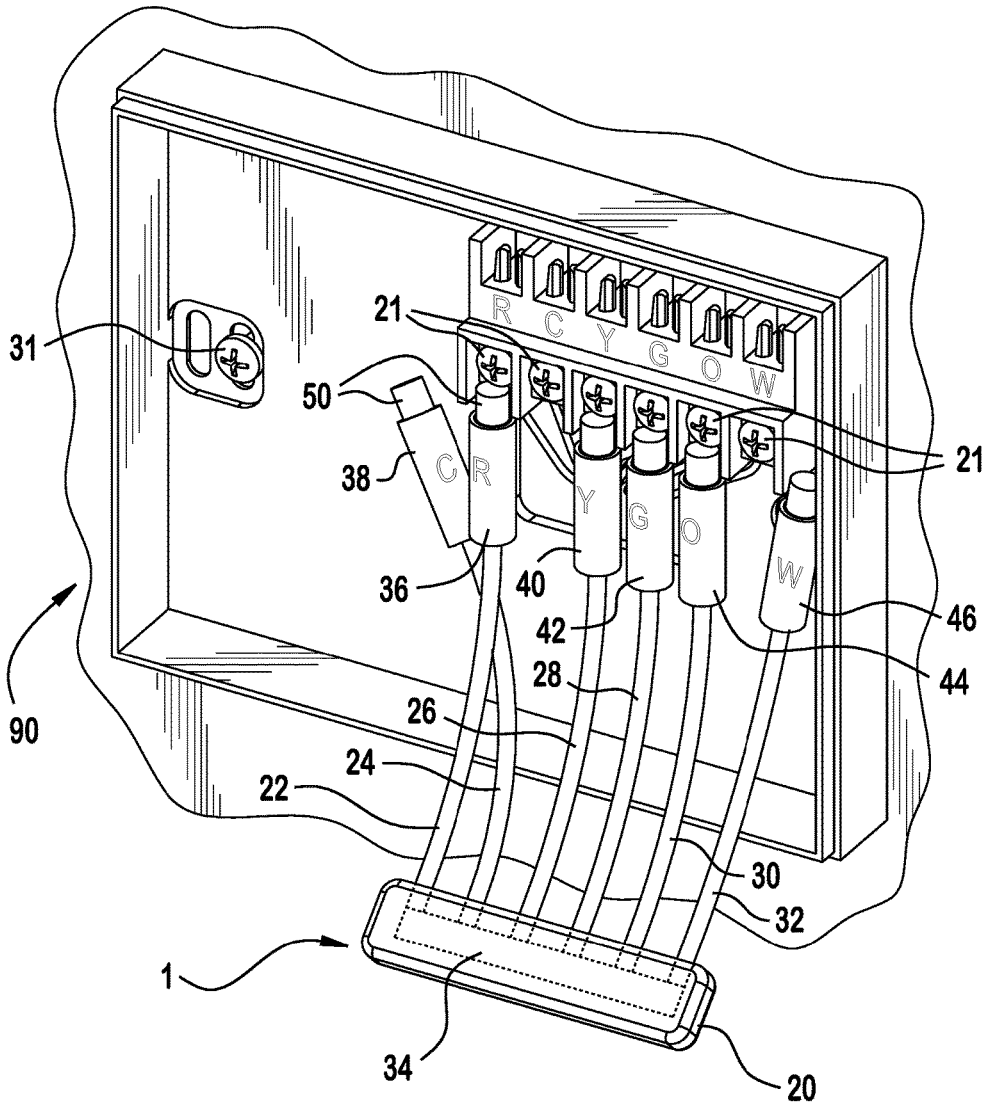
FIG. 1 is a perspective view of an electric circuit jumper cable assembly constructed in accordance with the present invention, and shown affixed to an electrical control panel.

As shown in FIG. 1, the electric circuit jumper cable assembly 1 generally includes the following major components: a housing 20, a plurality of conductors 22, 24, 26, 28, 30, and 32, and a plurality of terminals 36, 38, 40, 42, 44, and 46.

Figure 2:
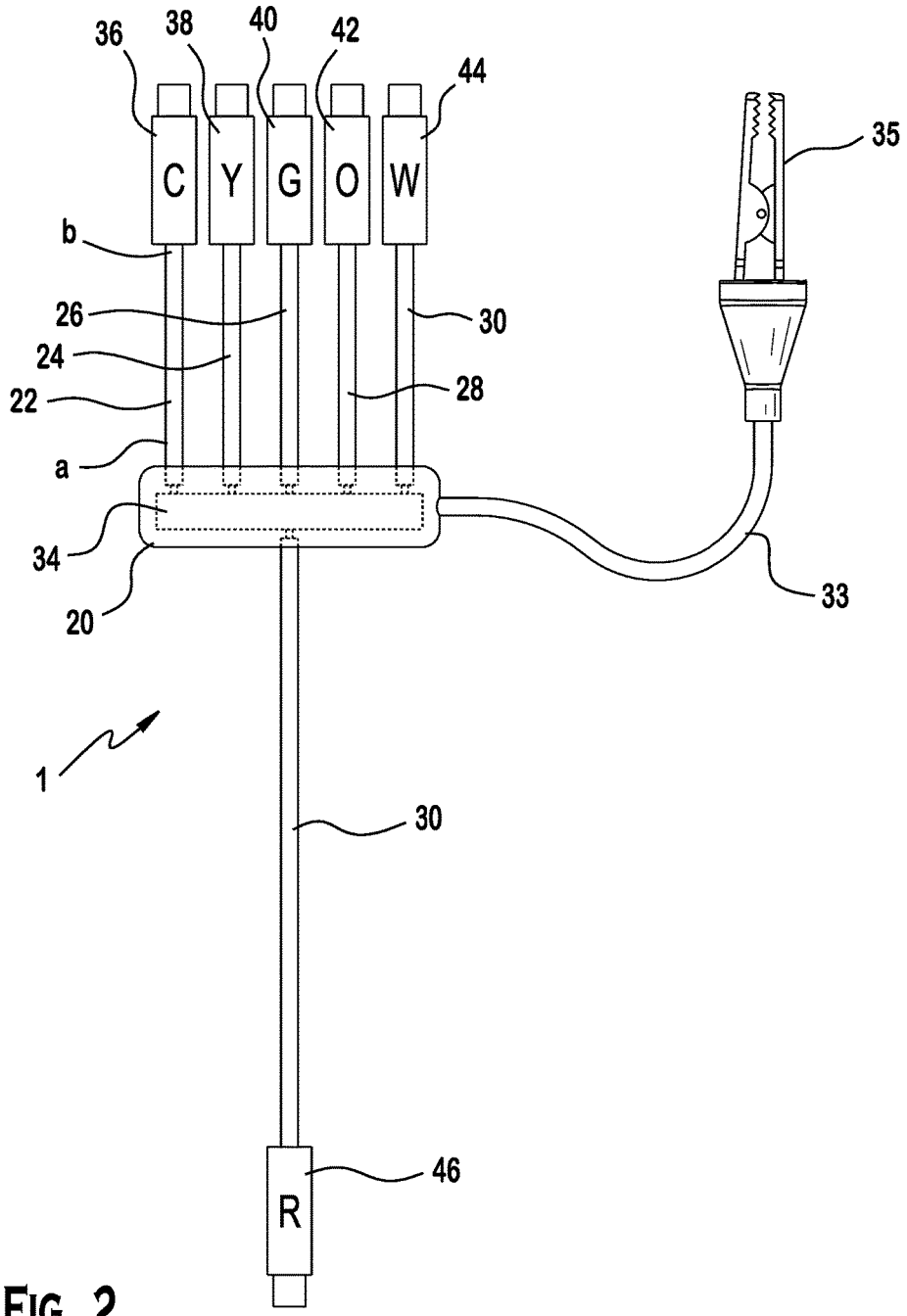
FIG. 2 is another electrical jumper cable assembly constructed in accordance with the present invention, showing multiple leads and a fastener.

The shown electric circuit jumper cable assembly 1, constructed in accordance with the present invention, the plurality of conductors 22, 24, 26, 28, 30, and 32 extend into the housing 20. Each conductor 22, 24, 26, 28, 30, and 32 is electrically connected, at first ends 22*a*, 24*a*, 26*a*, 28*a*, 30*a*, and 32*a* to form an electrical junction 33 in a bus 34 within housing 20. As is clear from FIGS. 1 and 2, the conductors 22, 24, 26, 28, 30, and 32 can extend into housing 20 in various different ways, such that all of the conductors enter the housing along one side of the housing as shown in FIG. 1 or that five of the conductors (output leads) enter the housing along one side of the housing and the sixth conductor (input lead) enters the housing at another side of the housing as shown in FIG. 2.

As shown, the electric circuit jumper cable assembly 1, constructed in accordance with the present invention, includes a plurality of terminals 36, 38, 40, 42, 44, and 46 individually connected at second ends 22*b*, 24*b*, 26*b*, 28*b*, 30*b*, and 32*b*, respectively, of the conductors 22, 24, 26, 28, 30, and 32.

For clarity, a representative terminal will be referred to hereinafter as "terminal 44". The representative "terminal 44" may be shown in different specific embodiments as described herein.

As shown in FIGS. 1-4, each terminal 44 has a base 47 and an electrically conductive tip 50 (hereinafter referred to as "tip 50") positioned within a barrel 48. The tip 50 is preferably cylinder-shaped, but may be configured in other shapes by those of ordinary skill in the art. The tip 50 is electrically connected to one of the conductors 22, 24, 26, 28, 30, and 32, for example, to conductor 30 at a second end 30*b*, and is preferably magnetized. Using magnetized tips allows operators to more easily complete and test circuits without requiring that a lead conductor be attached to a screw 21 or other connection device as is typical in the known art. A fastener 35 or other connector, such as clip or clamp, may be used at the end of an additional lead for connection to a unit undergoing troubleshooting or maintenance procedures. The fastener 35 may also be magnetized for further operational convenience.

Figure 3:
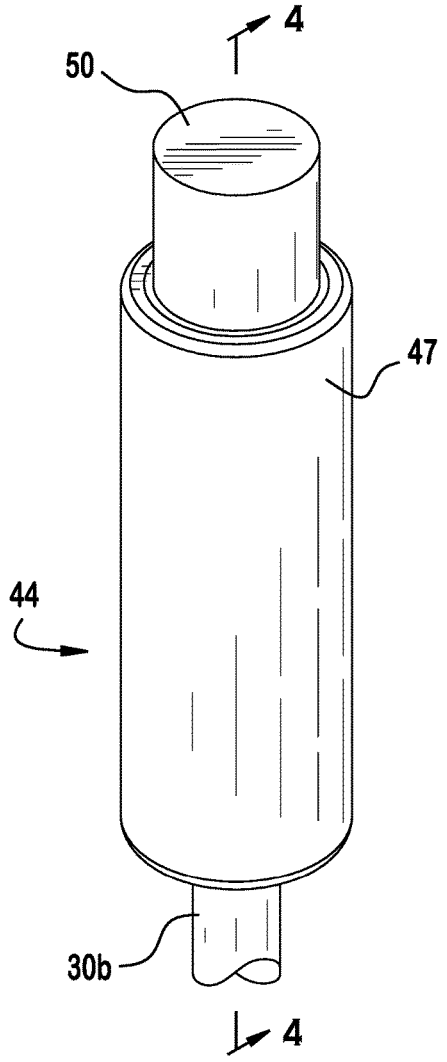
FIG. 3 is a perspective view of an individual lead of the multiple leads in FIG. 2.
Figure 4:
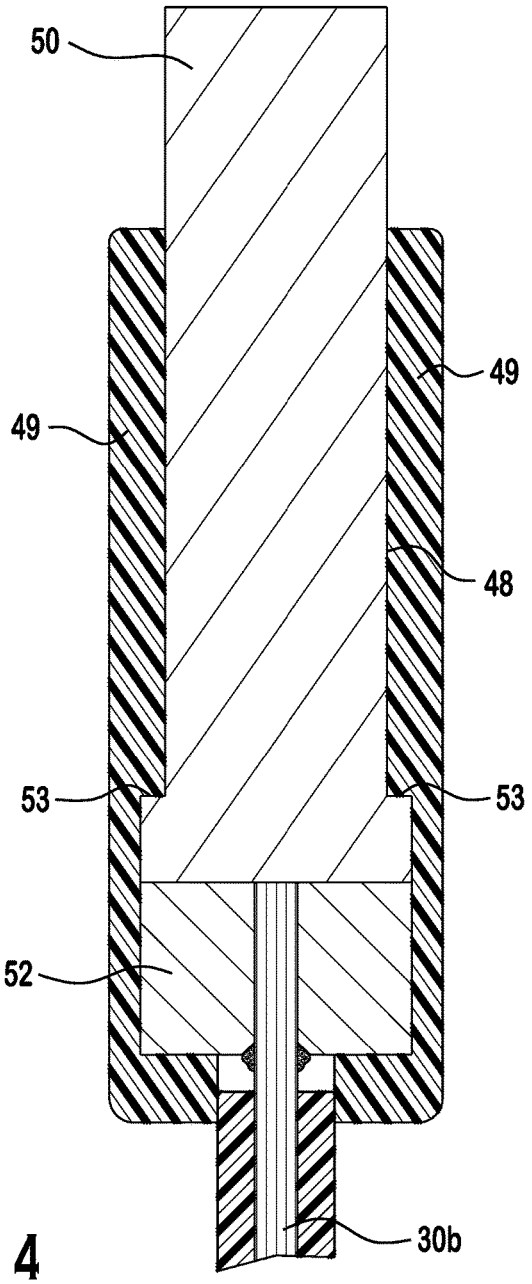
FIG. 4 is a cross-sectional view of the individual lead in FIG. 4 taken along line 4-4.

FIGS. 3 and 4 illustrate an exemplary terminal element of the invention wherein the magnet tip 50 is exposed and in a fixed position relative to the base 47 of the terminal. In this embodiment, the magnet tip 50 is held in place with complementary ledges 53 on the magnet tip 50 and the barrel 48. The magnet tip 50 abuts a conductor washer 52 which surrounds the conductor 30*b* which connects to the magnet tip 50. A portion of the tip 50 is contained within the generally cylindrical insulating barrel 48, the tip 50 greater in diameter at a first end than at a second end, the interior of the barrel 48 greater in diameter at a first end than at a second end, the first end of the tip 50 and the first end of the insulating barrel positioned adjacent to each other.

In additional embodiments of the invention, terminal 44 has a cover element 51, as described below to cover its tip 50. The cover element 51 accomplishes its function in a variety of ways. One way is with a cap, removal of which exposes the tip 50 and emplacement of which covers the tip 50. Another way is a mechanism that in various embodiments moves to cover or expose the tip 50. The various mechanism embodiments may move the tip 50 or may move the cover element 51 to cause the covering or exposing of the tip 50.

Figure 5:
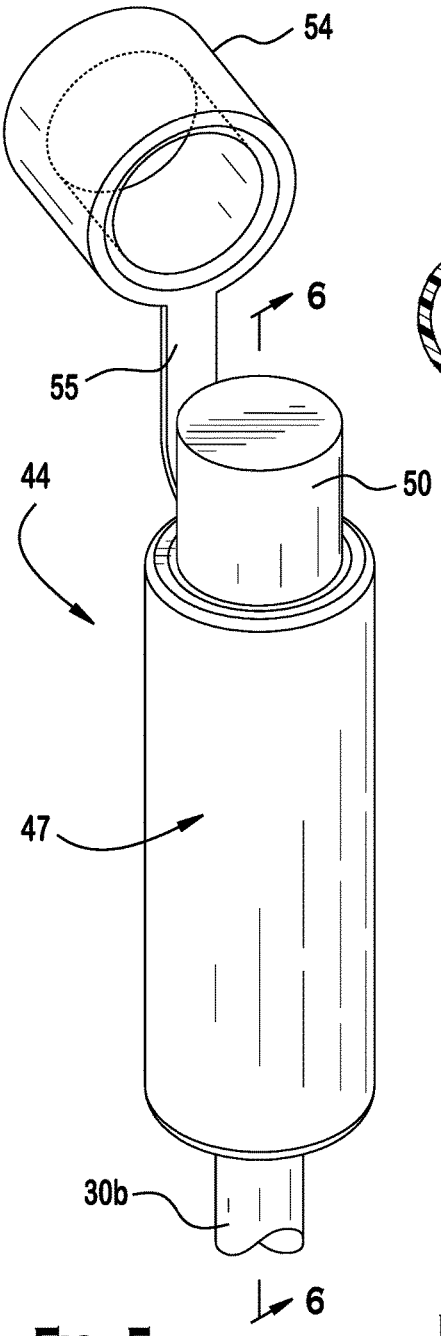
FIG. 5 is a perspective view of another individual lead of an electric circuit jumper cable assembly constructed in accordance with the present invention, showing a cover element in the form of a snap-off cap.
Figure 6:
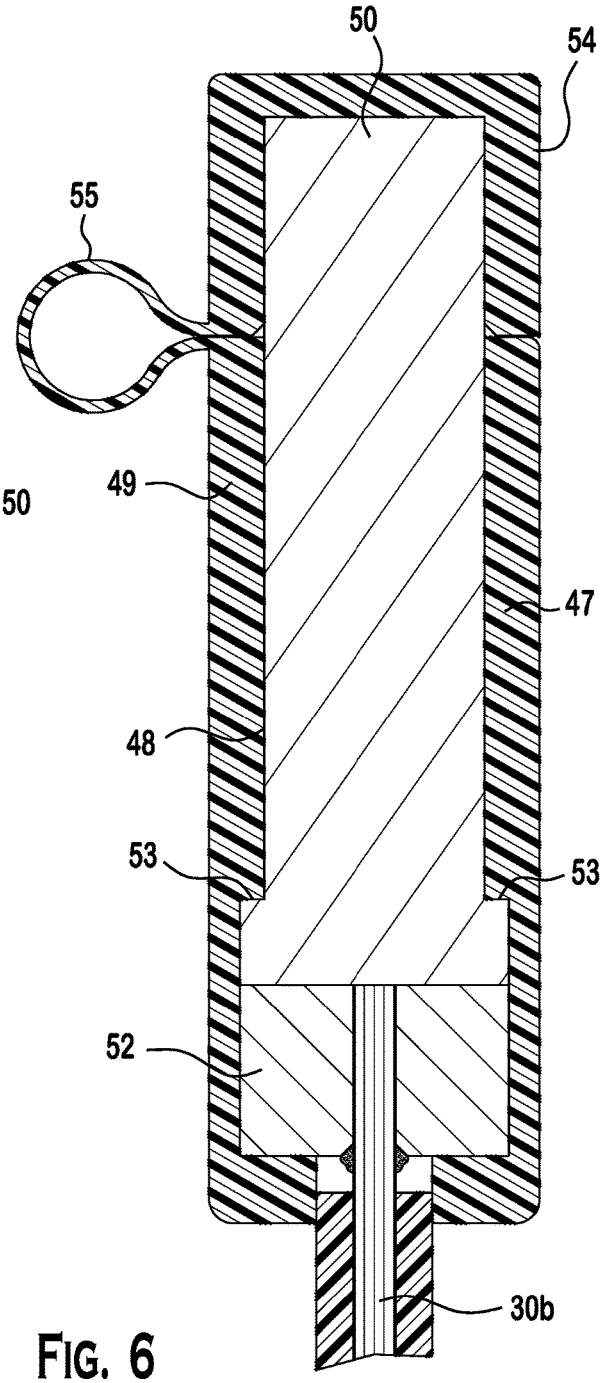
FIG. 6 is a cross-sectional view of the individual lead of FIG. 5 taken along line 6-6.
Figure 7:
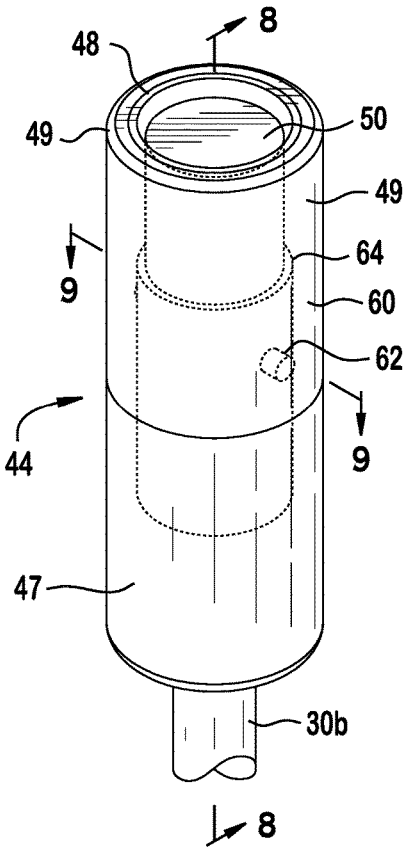
FIG. 7 is a perspective view of another individual lead of an electric circuit jumper cable assembly constructed in accordance with the present invention, showing a cover element in the form of a twist cap.
Figure 9:
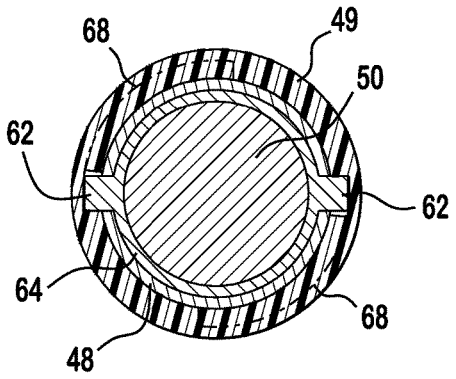
FIG. 9 is another cross-sectional view of the individual lead of FIG. 7 taken along line 9-9.
Figure 8:
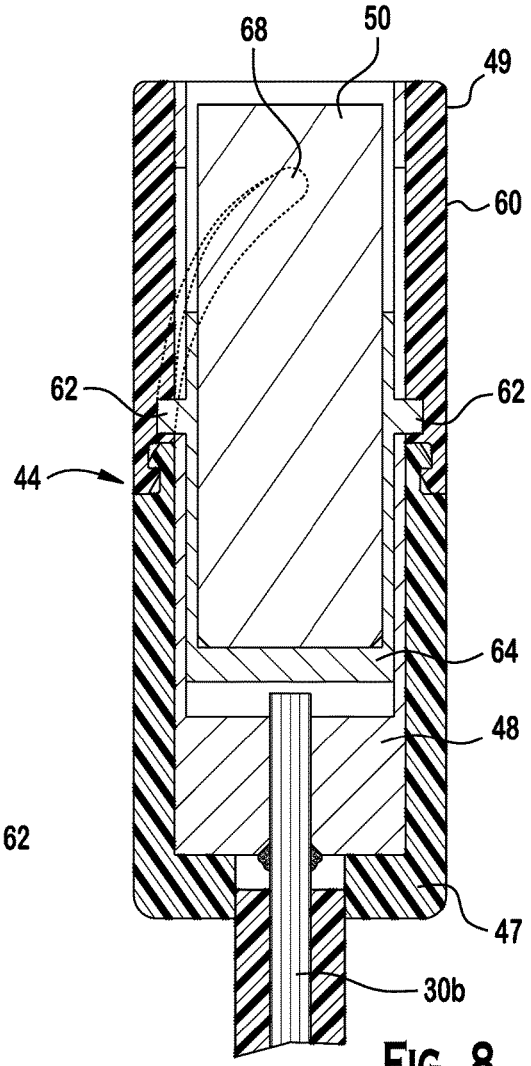
FIG. 8 is a cross-sectional view of the individual lead of FIG. 7 taken along line 8-8.
Figure 10:
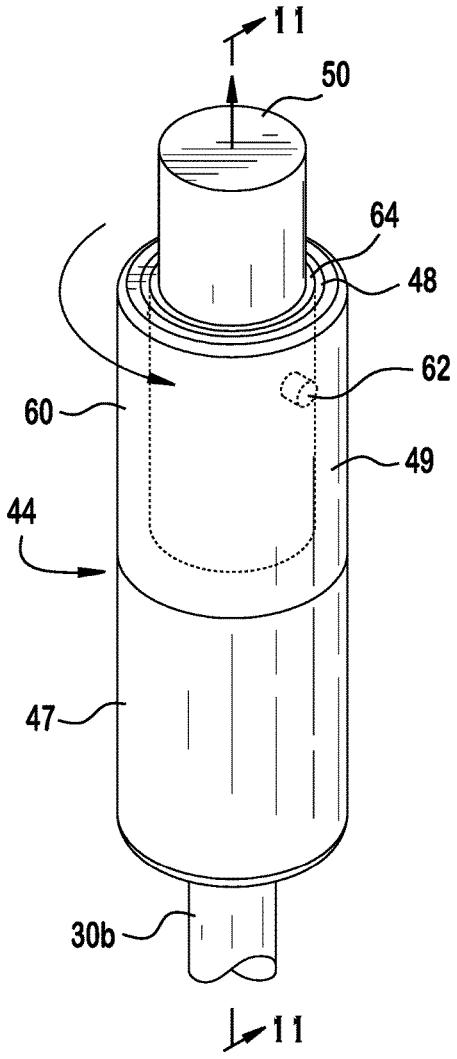
FIG. 10 is a perspective view of the individual lead of FIG. 7, showing twisting of the cover element to expose a conductive tip.
Figure 11:
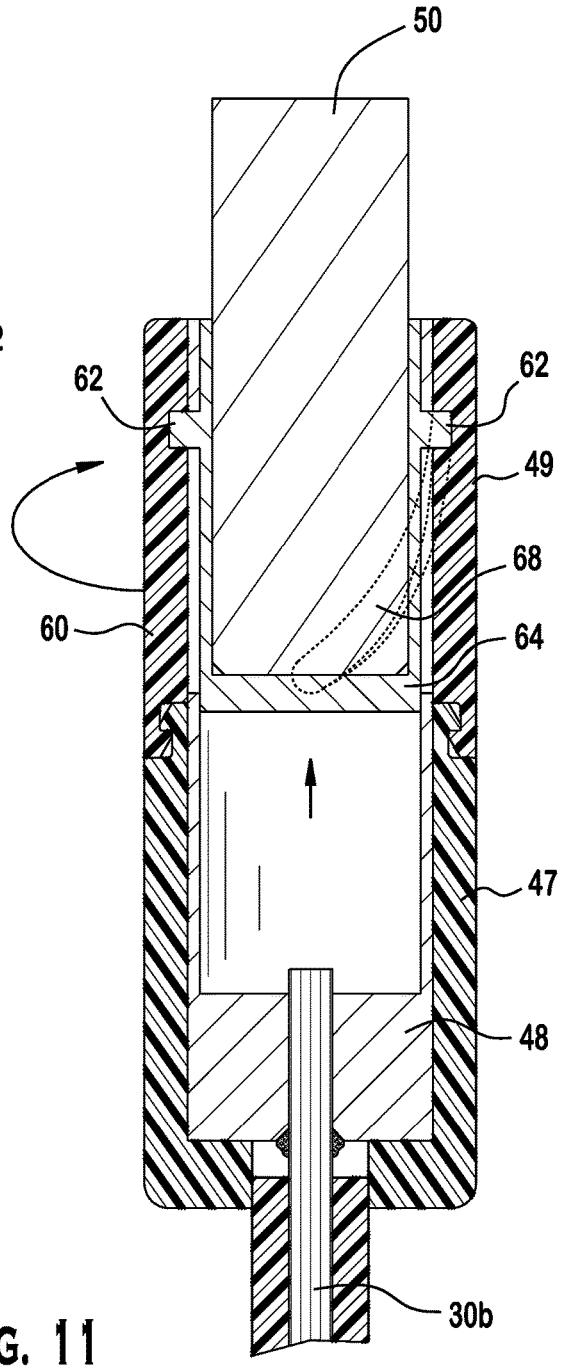
FIG. 11 is a cross-sectional view of the individual lead of FIG. 10 taken along line 11-11.
Figure 12:
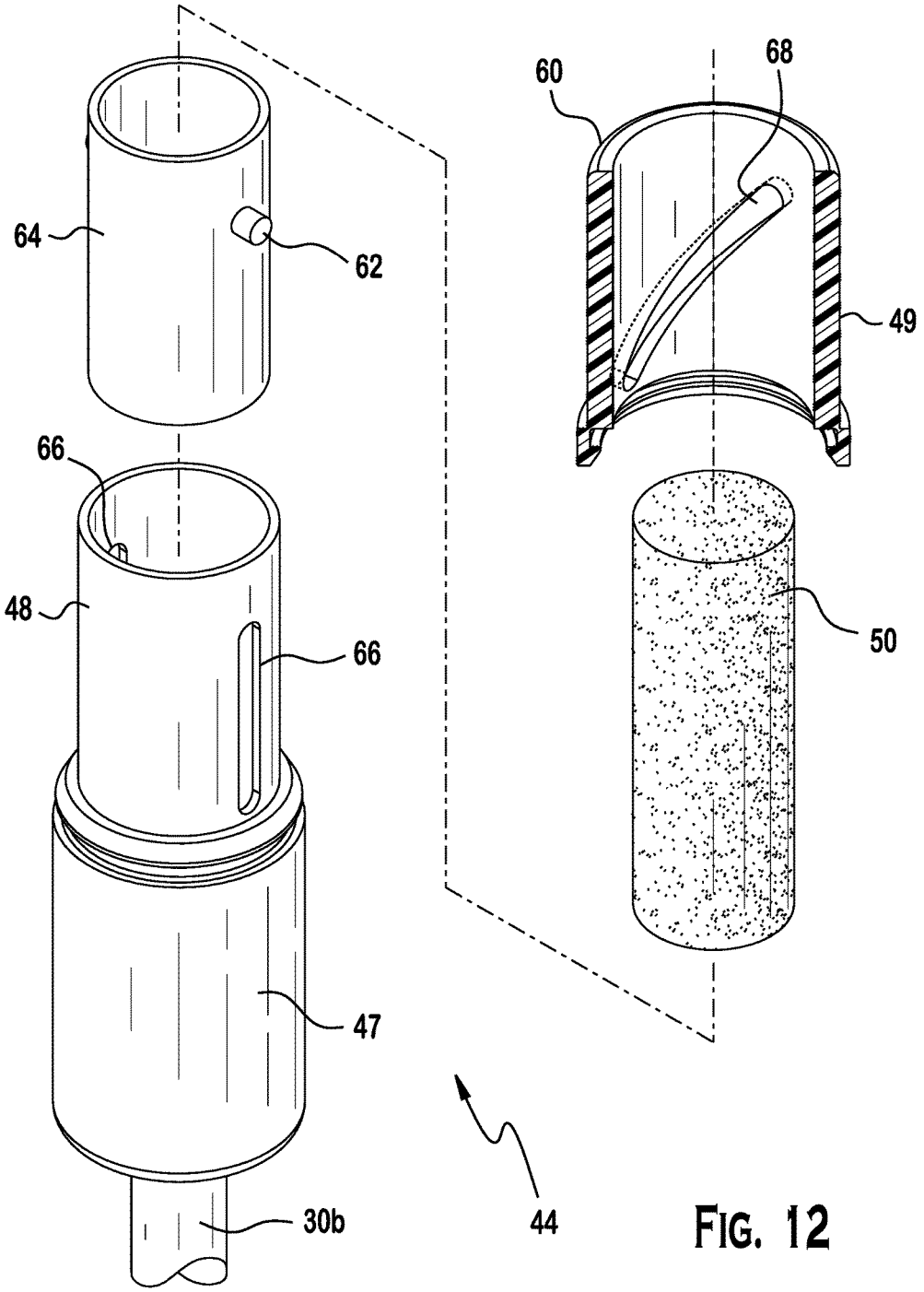
FIG. 12 is a perspective exploded view of the individual lead of FIG. 7.
Figure 13:
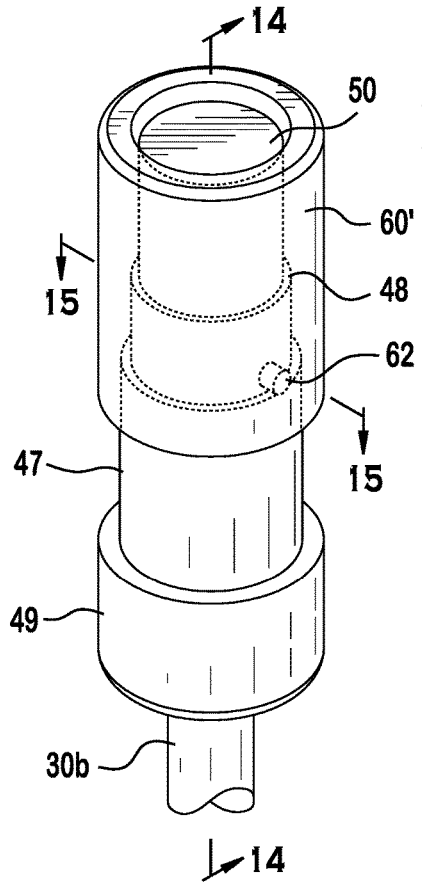
FIG. 13 is a perspective view of another individual lead of an electric circuit jumper cable assembly constructed in accordance with the present invention, showing another cover element in the form of a twist cap.
Figure 15:
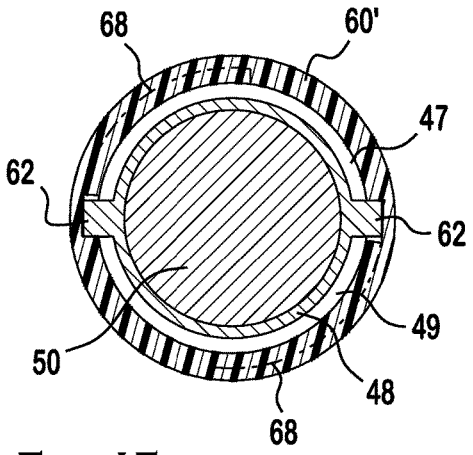
FIG. 15 is another cross-sectional view of the individual lead of FIG. 13 taken along line 15-15.
Figure 14:
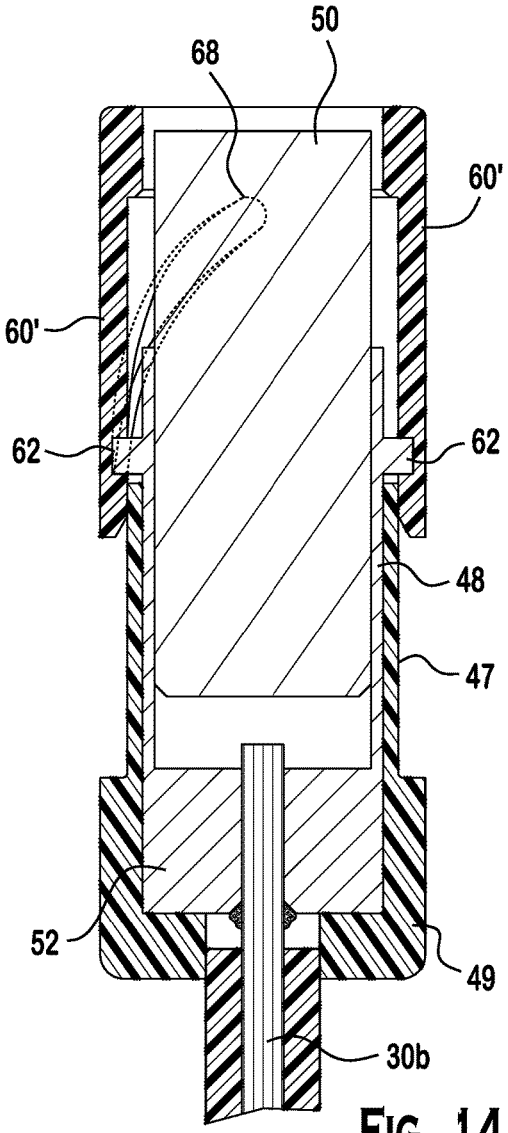
FIG. 14 is a cross-sectional view of the individual lead of FIG. 13 taken along line 14-14.
Figure 16:
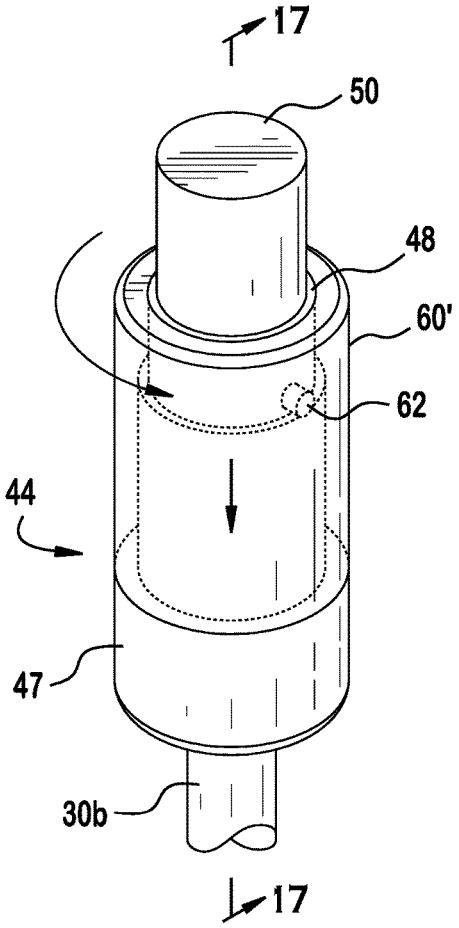
FIG. 16 is a perspective view of the individual lead of FIG. 13, showing twisting of the cover element to expose a conductive tip.
Figure 17:
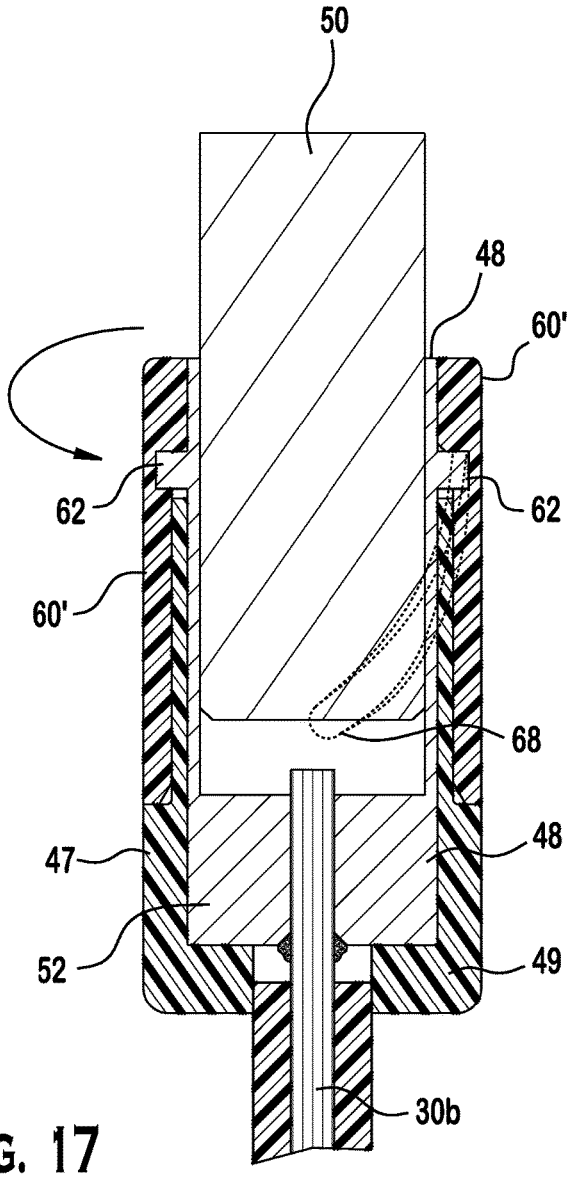
FIG. 17 is a cross-sectional view of the individual lead of FIG. 16 taken along line 17-17.

Referring to FIGS. 5 and 6, one such specific cover element 51, in the form of a snap-off cap 54, is moveable relative to base 47 of the terminal 44 to selectively expose or cover tip 50. The snap-off cap is designed to hold in place when it is desirable to cover the tip 50 and to be removable when it is desirable to expose the tip 50. A strap 55 joins cap 54 to base 47 to prevent loss of the snap-off cap 54 when it is not in place over the tip 50. In this embodiment, the tip 50 is secured in the barrel 48 with complementary ledges 53 at the end of the tip 50 adjacent to the connector washer 52.

In FIGS. 7 through 12, a further embodiment of the invention is shown and further includes a moveable cover element 51 in the form of a twist cap 60 that, when rotated as shown, exposes or shields the tip 50. Generally, the twist cap 60 includes a base 47, an insulation body 49, and a moveable sheath 64. Upon rotation, the twist cap 60 rotates about the longitudinal center of the terminal 44. This is performed through a set of lugs 62 (that protrude outwardly from a sheath 64) that are urged along a spiraled groove 68 in the interior surface of the insulation body 49 and simultaneously along a linear slot 66 in the barrel 48. The lateral and spiraled motions combine to expose or shield the tip 50 respectively by raising or lowering the tip 50 within the terminal 44 as in FIGS. 7-9 or FIGS. 10-11, respectively.

In FIGS. 13 through 17, a further embodiment of a twist cap 60' is shown, that, when rotated as shown, also exposes or shields the tip 50. However, in the shown embodiment, the insulation body 49 is moveable, while the sheath 64 is secured within the twist cap 60'. The insulation body 49 rotates about the longitudinal center of the sheath 64 through a similar construction of lugs 62 (that protrude outwardly from a sheath 64) and a spiraled groove 68 in the interior surface of the insulation body 49 as discussed above.

Figure 18:
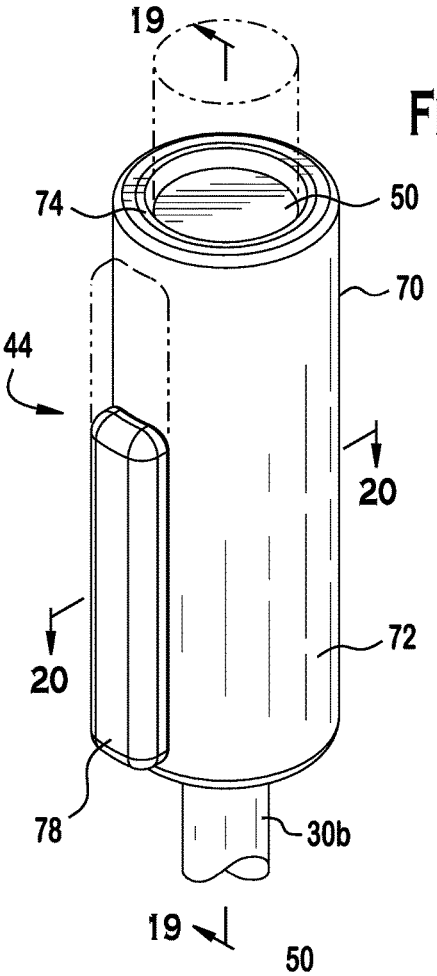
FIG. 18 is a perspective view of another individual lead of an electric circuit jumper cable assembly constructed in accordance with the present invention, showing a cover element having slidable sheath.
Figure 20:
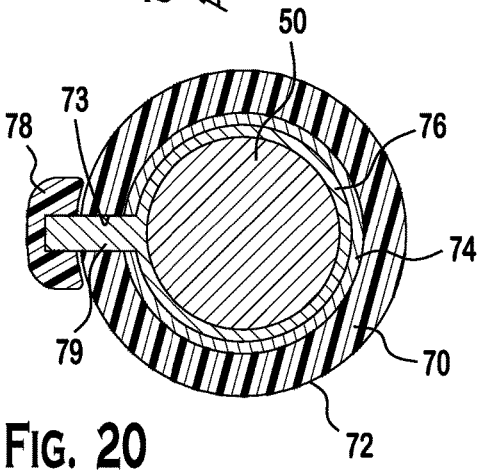
FIG. 20 is another cross-sectional view of the individual lead of FIG. 18 taken along line 20-20.
Figure 19:
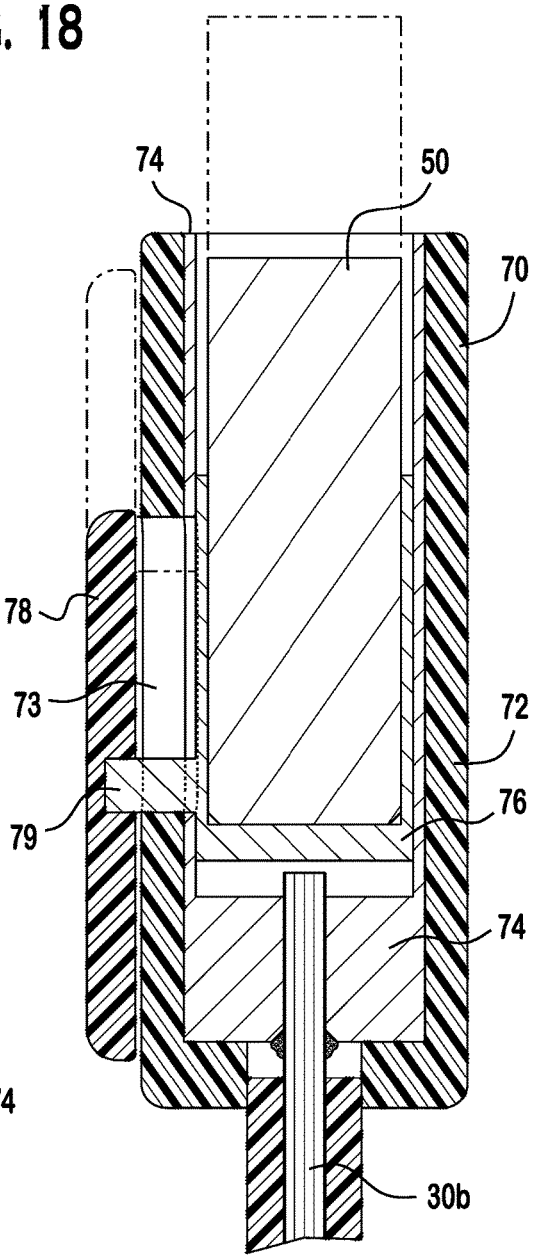
FIG. 19 is a cross-sectional view of the individual lead of FIG. 18 taken along line 19-19.

In FIGS. 18 through 20, a further embodiment of the invention is shown and further includes a fixed cover element 70 within which the tip 50 can be retracted or advanced. The fixed cover element 70 includes an insulation body 72, a barrel 74, and a moveable sheath 76. As particularly shown, when a force is applied to a slide tab 78, tip 50 is retracted or advanced along the length of the terminal 44. Structurally, the slide tab 78 is connected to a lift bar 79, which is then secured to or an extension of the moveable sheath 76. The moveable sheath 76 fits between the barrel 74 and the insulation body 72. The lift bar 79 interacts with the slide tab 78 through a passageway 73. Force on the slide tab 78, directed away from the second end of the conductor 30*b*, will expose the tip 50 by way of advancing the tip 50 along the barrel 74. Force on the slide tab 78 directed toward the second end of the conductor 30*b* will shield the tip 50 by way of retracting the tip 50. The conductor 30, the moveable sheath 76, and the second end of the conductor 30*b* transmit power to the magnet tip 50 by virtue of selecting conductive materials for these elements.

Figure 21:
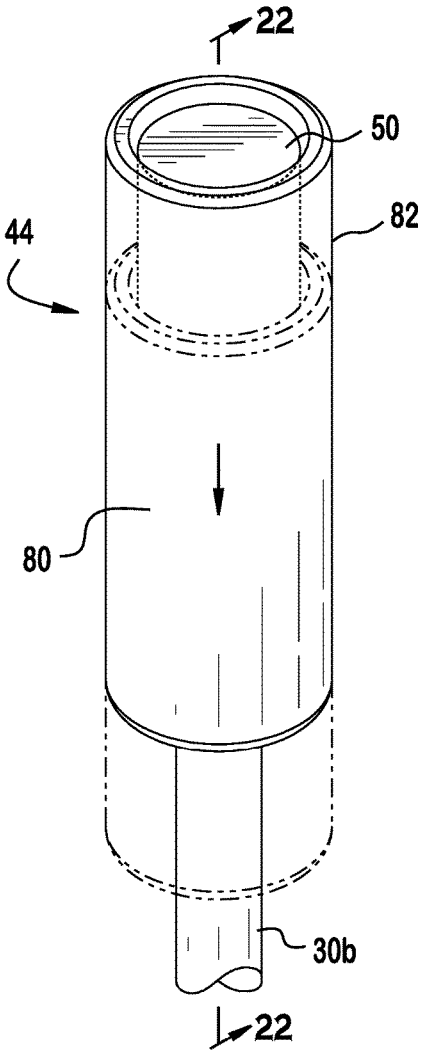
FIG. 21 is a perspective view of another individual lead of an electric circuit jumper cable assembly constructed in accordance with the present invention, showing a slidable cover element.
Figure 22:
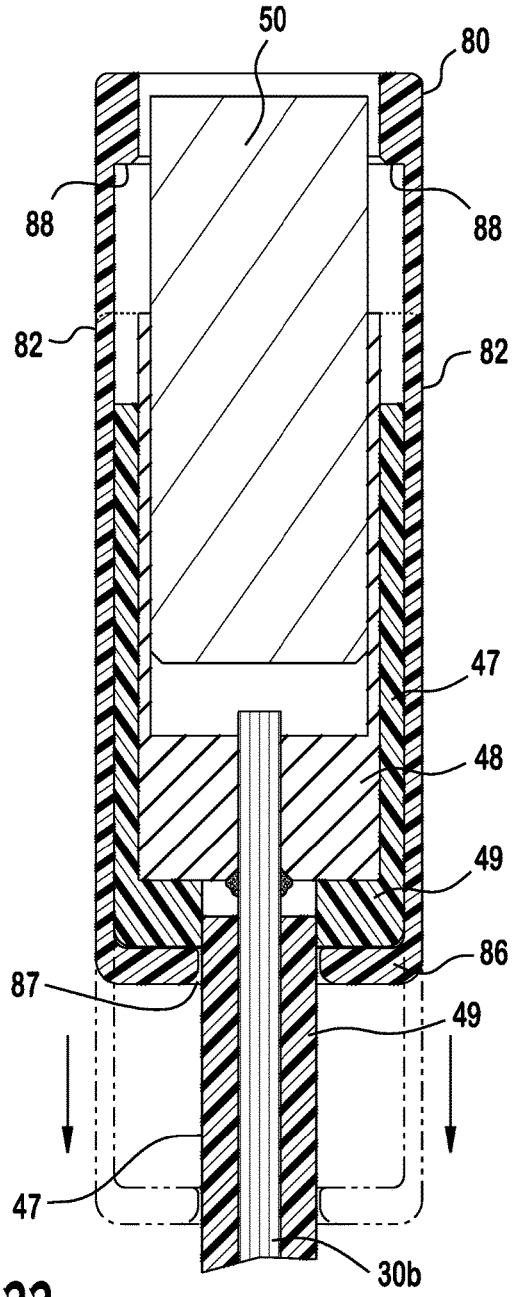
FIG. 22 is a cross-sectional view of the individual lead of FIG. 21 taken along line 22-22.

In FIGS. 21 and 22, a further embodiment of the invention includes a slidable cover element 80. In this embodiment, the terminal 44 has a sleeve 82 which is a cylinder fitting about an external surface of the base 47 and additionally having a lower wall 86 having a through passageway 87 sized to receive the conductor 30*b* and insulation body 49 surrounding the conductor 30*b*. When force is directed to move the sleeve 82 toward the second end of the conductor 30*b*, the tip 50 is exposed. When force is directed to move the sleeve 82 away from the second end of the conductor 30*b*, the tip 50 is shielded. The sleeve 82, when moved along the base 47 toward the second end of conductor 30*b*, is prevented from detaching from the base 47 by a ledge 88 opposite the lower wall 86 and sized to stop against the upper edge of the base 47.

The electric circuit jumper cable assembly 1, constructed in accordance with the present invention, optionally includes a fastener 35 for attaching housing 20 on a unit with which the electric circuit jumper cable assembly 1 is being used. In the embodiment of the present invention shown in FIG. 2, this fastener is secured to housing 20. The fastener 35 may be magnetized for convenient operation. Other mechanical devices may be used.

Now referring particularly to FIGS. 1-7 and 23-35, the electric circuit jumper testing cable assemblies 1 and 100 respectively have a plurality of jumper testing leads, each lead having a first end "a" and each lead having a second end "b", a magnetized tip 50 at the second end (as, for instance on 30*b*), and an electrical junction 33 where the leads are serially connected, within a bus 34, the bus 34 contained in a housing 20, and having a hanger means 31.

FIGS. 1-7 and 23-25 indicate various embodiments, arrangements, and relationships of the bus 34 to the jumper testing conductors and various specific terminals in use.

The electrical control panel 90 is of such dimensions to accommodate the plurality of jumper leads 22-32 and terminals 36-46 and an array of indicators 92 when in use.

FIG. 1 shows an electric circuit jumper cable assembly 1, constructed in accordance with the present invention, mounted to an electrical control panel 90. In the shown embodiment, the tips 50 at the second ends of the conductors 30 are placed in contact respectively with the array of indicators 92. In FIG. 1, tips 50 within terminals 36, 38, 40, 42, 44, and 46, respectively, are shown exposed.

Figure 23:
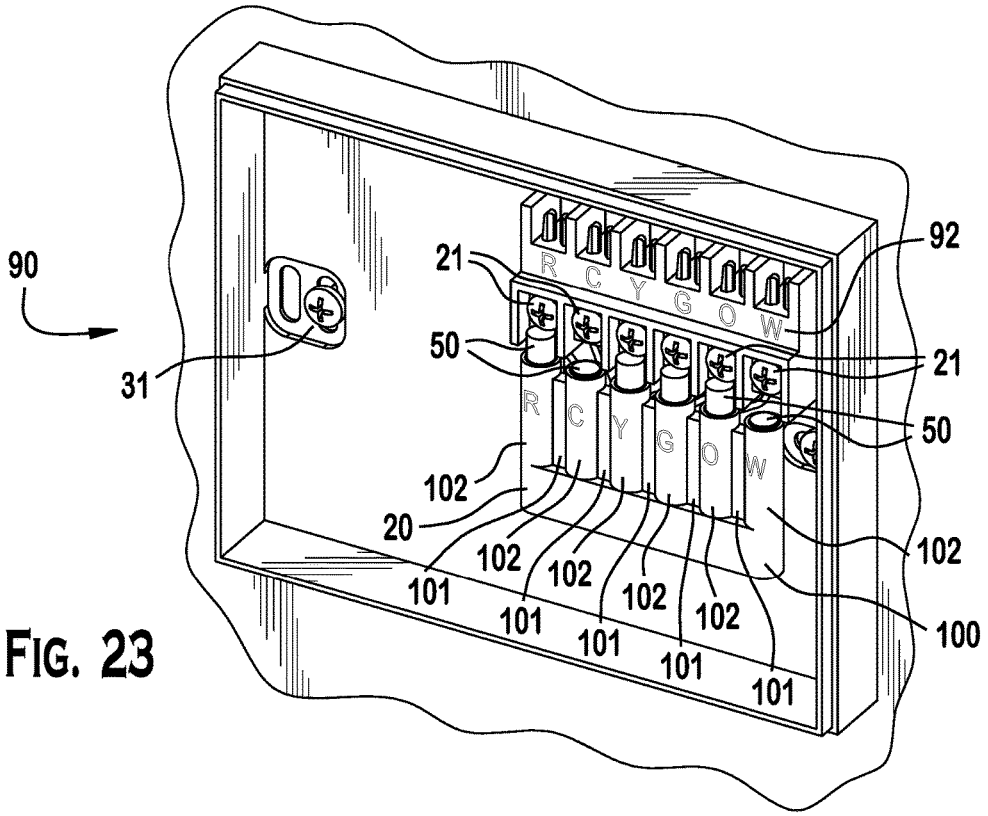
FIG. 23 is a perspective view of another electric circuit jumper cable assembly constructed in accordance with the present invention, and shown affixed to an electrical control panel.
Figure 24:
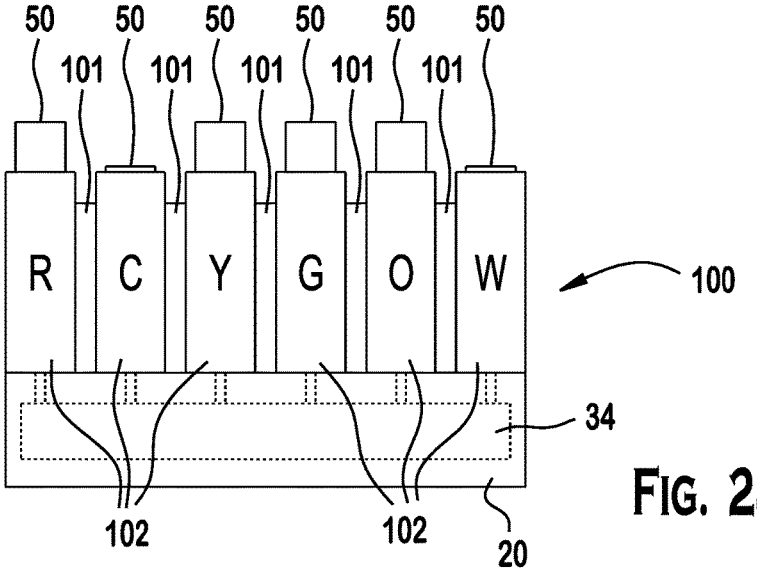
FIG. 24 is a front view of the electric circuit jumper cable assembly of FIG. 23.

In contrast, as shown in FIGS. 23 and 24, another electric circuit jumper cable assembly 100 according to the invention is shown. In FIGS. 23 and 24, tips 50 within terminals 36, 40, 42, and 44, respectively, are shown exposed.

In the shown embodiment, the tips 50 are contained within terminal sleeves 102 of the terminals 36-46. A plurality of supports 101 are used between adjacent terminals 36-46 to align the plurality of terminals and to form a single integrated unit that is convenient to connect to an array of indicators 92. Indicators 92 are LED lights that illuminate when a particular circuit is complete. Other types of indicators (i.e., to produce sound) are known to those of ordinary skill in the art.

Figure 25:
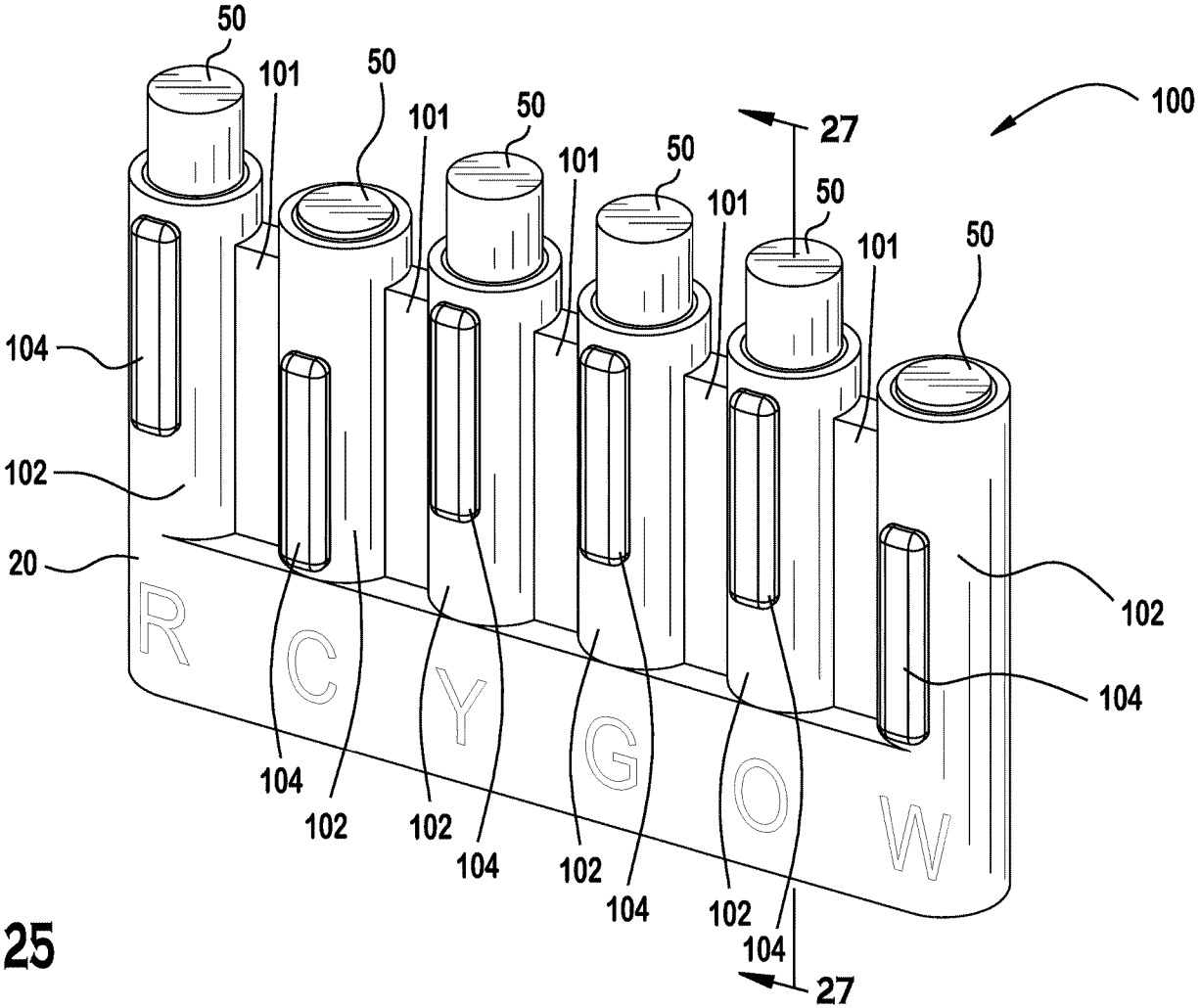
FIG. 25 is another perspective view of the electric circuit jumper cable assembly of FIG. 23.
Figure 26:
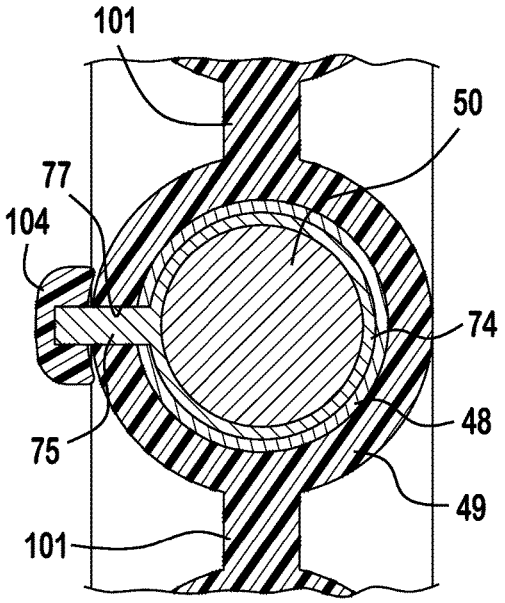
FIG. 26 is a cross-sectional view of the electric circuit jumper cable assembly of FIG. 27 taken along line 26-26.
Figure 27:
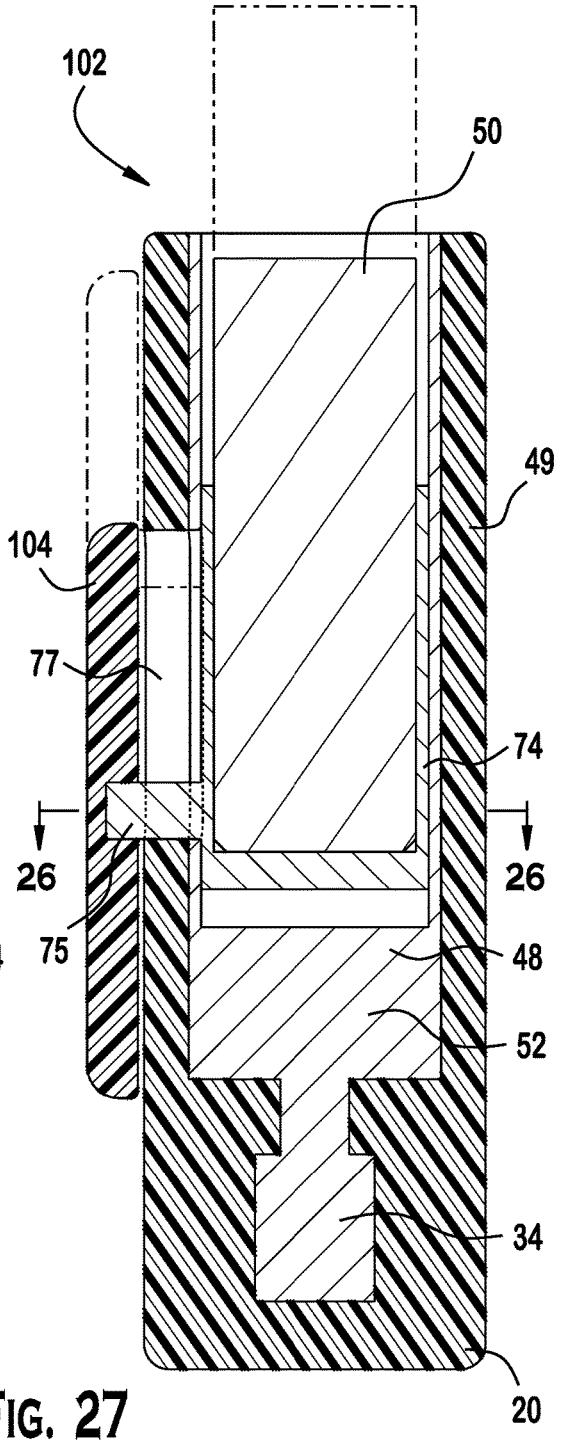
FIG. 27 is a cross-sectional view of the electric circuit jumper cable assembly of FIG. 25 taken along line 27-27.
Figure 28:
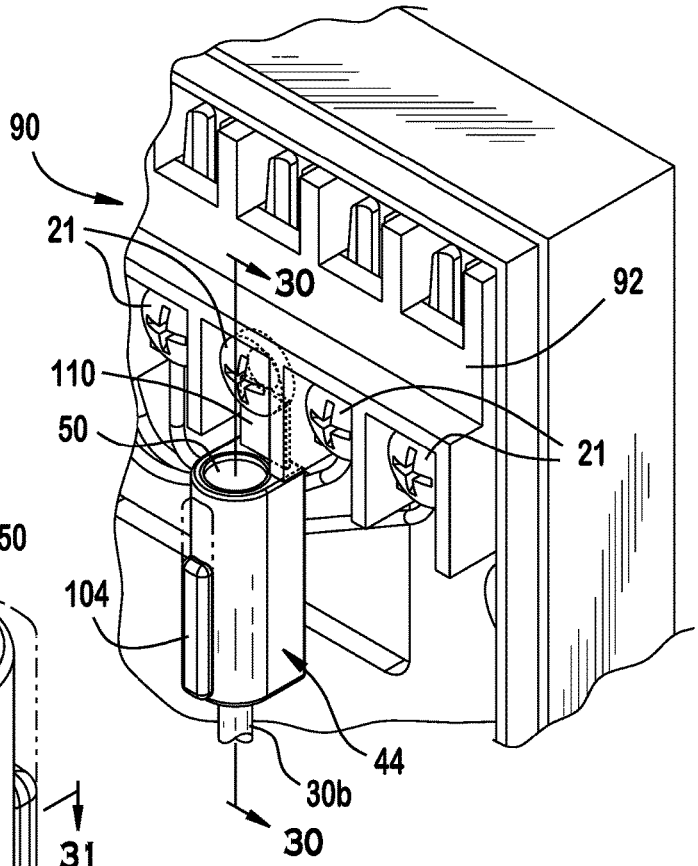
FIG. 28 is a perspective view of another electric circuit jumper cable assembly constructed in accordance with the present invention, and showing a contact plate extending therefrom and affixed to an electrical control panel.
Figure 29:
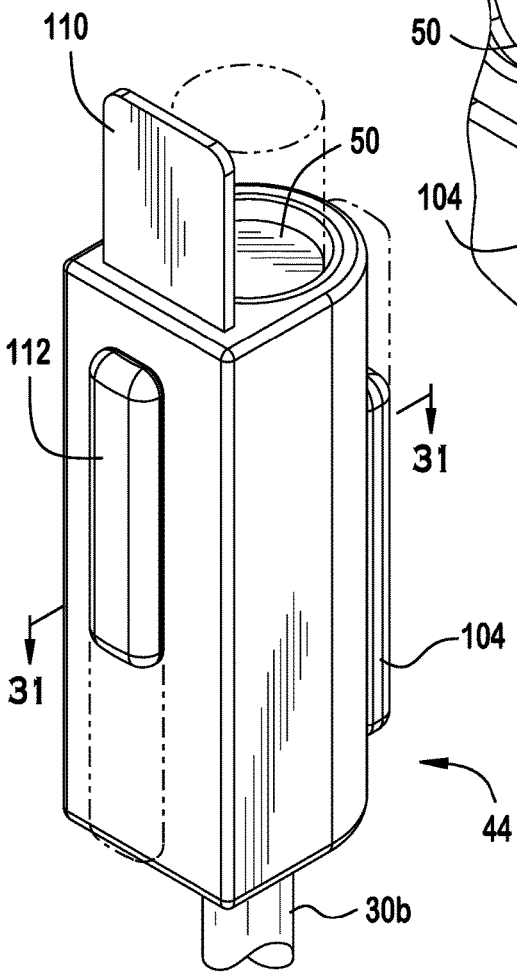
FIG. 29 is a perspective close-up view of the electric circuit jumper cable assembly of FIG. 28.

As shown in FIGS. 25-27, the electric circuit jumper cable assembly 100 has specific terminals 36-46. FIG. 25 more specifically shows that slide tabs 104 are used to position the tips 50, so as to create a contact with one of the array of indicators 92. In FIG. 23, the tip 50 makes contact directly with a screw 21. In FIG. 28, the tip 50 makes contact indirectly by means of a contact plate 110 as discussed in more detail below.

As shown in FIGS. 26 and 27, the electric circuit jumper assembly 100 includes a moveable sheath 74 having a lift bar 75 positioned within the through passageway 77. When force is applied to the slidable tab 104, the moveable sheath 74 advances the tip 50 from a retracted position within the barrel 48 of the terminal 44 to an exposed position. Once exposed, tip 50 is in position to connect to an indicator 92. In a nested or retracted position, the tip 50 is out of position to connect to one the indicator 92. Exerting force on the slide tab 104 varies the retraction and exposure of tip 50.

Figures 30, 31:
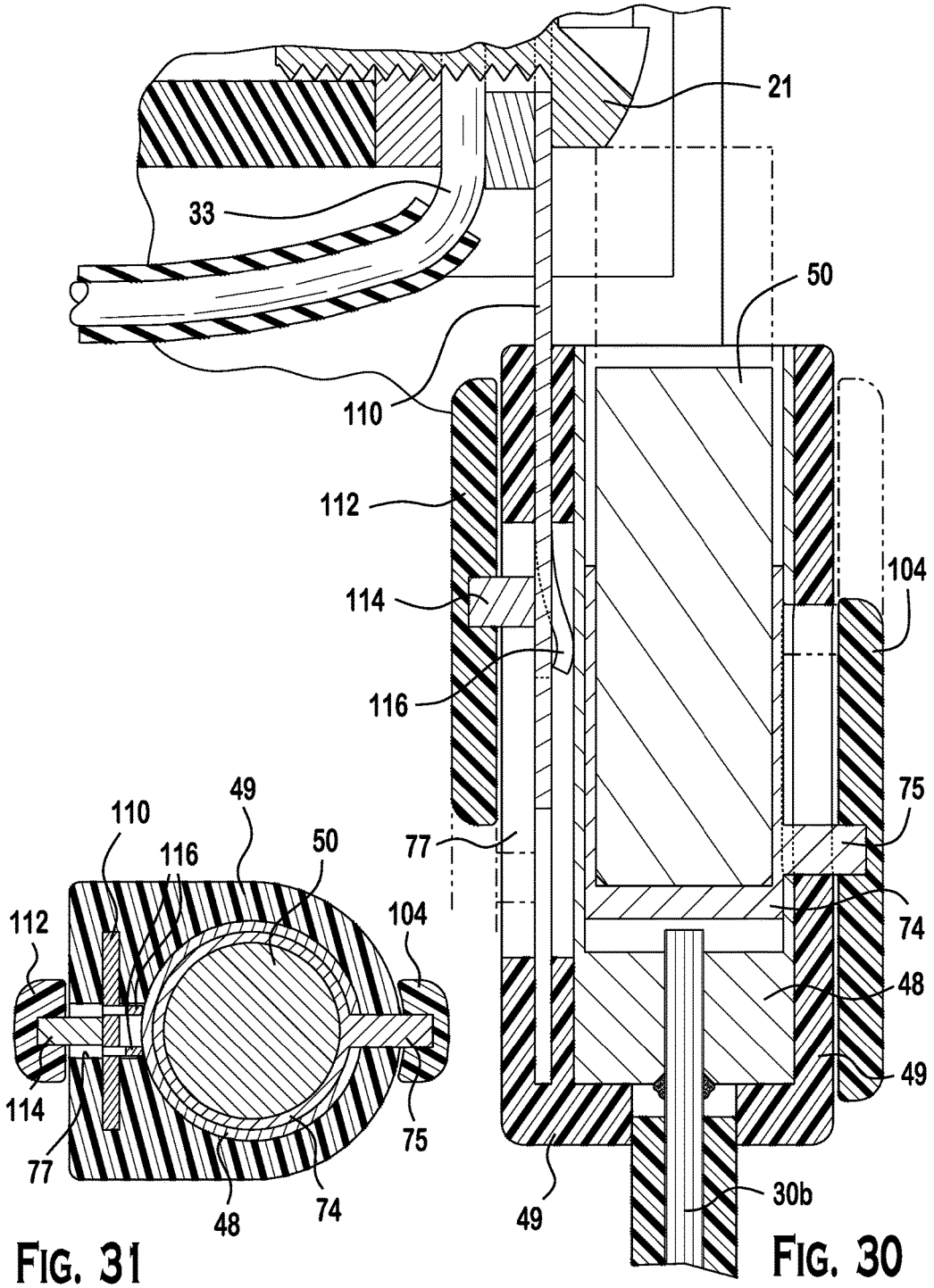
FIG. 30 is a cross-sectional view of the electric circuit jumper cable assembly of FIG. 28 taken along line 30-30.
FIG. 31 is a cross-sectional view of the electric circuit jumper cable assembly of FIG. 28 taken along line 29-29.

FIGS. 28 through 31 show a further embodiment of the invention having a contact plate 110 to use in an alternative connection between the tip 50 and the screw 21 on the electrical control panel 90. In particular, FIG. 30 shows a cross-sectional view along lines 30-30 of FIG. 28. The contact plate 110 is retracted or raised by moving a slide tab 112. The contact plate 110 has a lift bar 114 protruding from the contact plate 110 outward-facing surface and interacting with the inward-facing surface of the slide tab 112. Exerting force on the slide tab 112 varies the retraction and exposure of the contact plate 110. The contact plate 110 is retained in place with a retention piece 116 which also communicates power from the conductor 30 to the contact plate 110 by virtue of the particular conductive materials chosen by one of ordinary skill in the art. The contact plate 110 is designed to fit at its exposed end between screw 21 and conductor 33 to indicator 92.

The terms "comprise", "comprises", and "comprising" have an inclusive meaning as used in this specification. This statement is made acknowledging that these terms may be understood in different jurisdictions to have an exclusive or inclusive meaning. For the purposes of this specification, and unless otherwise noted, the terms are to be understood as having an inclusive application to listed components—i.e., a function that includes specifically referenced components or elements, and optionally also the inclusion of other non-specified components or elements.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electric circuit jumper cable assembly, comprising:

an insulating housing covering a bus bar;

a plurality of output conductors electrically positioned in parallel and connected at first ends of the conductors to form an electrical junction using the bus bar;

a plurality of output terminals individually connected at second ends of said output conductors, each output terminal having:

an insulating barrel, an electrically conductive tip in said base electrically connected to one of said leads; and a cover element relative to the insulating barrel that selectively shields at least a portion of said electrically conductive tip;

an input conductor electrically connected in series with the plurality of output conductors through the bus bar;

an output terminal connected the input conductor and having:

an insulating barrel, and an electrically conductive tip positioned in the insulating barrel and electrically connected to the output conductor.

2. The electrical jumper cable assembly according to claim 1, further comprising a fastener positioned between the plurality of output conductors and the input conductor.

3. The connector according to claim 2, where in the fastener is a clip.

4. The electrical jumper cable assembly according to claim 1, wherein the insulating barrel of the output conductor is cylindrical shaped and has a receiving passageway covering at least a portion of the electrically conductive tip.

5. The electrical jumper cable assembly according to claim 4, wherein the insulated base of the input conductor is is cylindrical shaped and has a receiving passageway covering at least a portion of the electrically conductive tip.

6. The electrical jumper cable assembly according to claim 5, wherein the electrically conductive tip of the input conductor is greater in diameter at a first end than at a second end.

7. The electrical jumper cable assembly according to claim 6, wherein the electrically conductive tip of the output conductor is greater in diameter at a first end than at a second end.

8. The electrical jumper cable assembly according to claim 7, wherein the first end of the electrically conductive tip and the first end of the insulating barrel are positioned adjacent to each other.

9. The electric circuit jumper cable assembly according to claim 1, wherein each of said cover elements is a cap that is movably attached to said base of said output terminal.

10. The electric circuit jumper cable according to claim 9, wherein each of said cover elements is a snap-off cap.

11. The electric circuit jumper cable according to claim 9, wherein each of said cover elements is a twist cap that is attached to said base of said output terminal.

12. The electric circuit jumper cable according to claim 9, wherein each of said cover elements is a sleeve that slides along said base of said output terminal.

13. The electric circuit jumper cable according to claim 5, wherein the electrically conductive tip of the output terminals is moveable within the insulating barrel between a retracted position and an exposed position.

14. The electrical jumper cable assembly of claim 1, wherein the plurality of output terminals are aligned by supports to form an integrated unit adapted to fasten to a unit.

15. The electrical jumper cable assembly of claim 14, wherein each of the plurality of output terminals further comprise a contact plate movable with a slidable tab within the terminal.

* * * * *